US011335275B2

(12) United States Patent
Kim et al.

(10) Patent No.: US 11,335,275 B2
(45) Date of Patent: May 17, 2022

(54) SOURCE DRIVER

(71) Applicant: Silicon Works Co., Ltd., Daejeon (KR)

(72) Inventors: Won Kim, Daejeon (KR); Young Bok Kim, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 17/317,609

(22) Filed: May 11, 2021

(65) Prior Publication Data

US 2021/0358421 A1 Nov. 18, 2021

(30) Foreign Application Priority Data

May 12, 2020 (KR) ..... 10-2020-0056378

(51) Int. Cl.
*G09G 3/3291* (2016.01)

(52) U.S. Cl.
CPC ... *G09G 3/3291* (2013.01); *G09G 2310/0289* (2013.01); *G09G 2310/0294* (2013.01); *G09G 2310/0297* (2013.01)

(58) Field of Classification Search
CPC ..... G09G 3/3291; G09G 3/3233
See application file for complete search history.

(56) References Cited

U.S. PATENT DOCUMENTS

| | | | | |
|---|---|---|---|---|
| 8,988,329 | B2 * | 3/2015 | Yoon | G09G 3/3233 345/77 |
| 10,665,174 | B2 * | 5/2020 | Park | G09G 3/3291 |
| 11,037,492 | B2 * | 6/2021 | Shin | G09G 3/3225 |

FOREIGN PATENT DOCUMENTS

| | | |
|---|---|---|
| KR | 2018-0043914 A | 5/2018 |
| KR | 2018-0061884 A | 6/2018 |
| KR | 2019-0045780 A | 5/2019 |
| KR | 2020-0048967 A | 5/2020 |

* cited by examiner

*Primary Examiner* — Sardis F Azongha
(74) *Attorney, Agent, or Firm* — Polsinelli PC

(57) ABSTRACT

The present disclosure discloses a source driver capable of accurately sensing characteristics of a display panel by minimizing the influence of a floating channel. The source driver may include normal channels connected to pixels of a display panel, a floating channel under no-load; and a sampling circuit configured to sample signals of the normal channels and the floating channel. The source driver may provide a first reference voltage to the floating channel in a first period in which characteristics of the pixels are sensed.

13 Claims, 4 Drawing Sheets

SOURCE DRIVER

BACKGROUND

1. Technical Field

The present disclosure relates to a display device, and more particularly, to a source driver capable of accurately sensing characteristics of a display panel by minimizing the influence of a floating channel.

2. Related Art

In general, a display device may include a display panel, a source driver, a timing controller, etc.

The source driver converts, into a data voltage, image data provided by the timing controller, and provides the data voltage to the display panel. The source driver may be integrated as a chip. The number of source drivers configured in the display panel may be determined by considering the size and resolution of the display panel.

Horizontal resolution of the display panel may be defined as the product of the number of subpixels, the number of channels of the source driver and the number of source drivers.

However, if horizontal resolution of the display panel and the number of channels of the source driver do not become a positive number times, some of the plurality of source drivers may include a floating channel under no-load.

A source driver according to a conventional technology is configured to prevent abnormal output under no-load by setting the state of a floating channel as a disable state.

A source driver for an OLED panel has embedded therein a sensing circuit for compensating for a pixel deviation. The sensing circuit is configured in an array form with respect to the channels of the source driver, and is configured to receive a sensing signal through each channel. In this case, the sensing circuit may sense unknown input through the floating channel of the source driver.

If the unknown input is sensed by the sensing circuit, the following problems may occur.

The sensing circuit may affect data of an adjacent normal channel due to an operation of the floating channel for sensing the unknown input through the floating channel. In this case, there is a problem in that a mismatch between the channels occurs.

Furthermore, the source driver outputs, to the timing controller, an output code corresponding to the unknown input through the floating channel. Therefore, the timing controller has a problem in that it requires a separate calculation process for distinguishing between output codes of the normal channel and the floating channel upon data processing.

SUMMARY

Various embodiments are directed to providing a source driver capable of accurately sensing characteristics of a display panel by minimizing the influence of a floating channel.

In an embodiment, a source driver may include a normal channel connected to pixels of a display panel, a floating channel under no-load, and a sampling circuit configured to sample signals of the normal channel and the floating channel. The source driver may provide a first reference voltage to the floating channel in a first period in which characteristics of the pixels are sensed.

In an embodiment, a source driver may include a sampling circuit configured to sample a signal of a multi-channel comprising a normal channel and a floating channel and provide a sampling signal, a multiplexer configured to output the sampling signal to an analog-to-digital converter in a preset sequence, and the analog-to-digital converter configured to convert the sampling signal into digital data. The source driver may provide a first reference voltage to the floating channel in a first period in which characteristics of pixels of a display panel are sensed through the normal channel.

According to embodiments, a problem in that an operation of the floating channel for sensing unknown input affects data of an adjacent normal channel can be prevented by supplying the first reference voltage to the floating channel when characteristics of pixels are sensed.

Furthermore, embodiments can simplify a process of calculating characteristics of the source driver and characteristics of pixels because the timing controller can distinguish between digital data of normal channels and the floating channel upon data processing.

DETAILED DESCRIPTION

Embodiments provide a source driver capable of accurately sensing characteristics of a display panel by minimizing the influence of a floating channel.

The source driver may include the floating channel if horizontal resolution of a display panel and the number of channels of the source driver do not become a positive number times.

In embodiments, a normal channel may be defined as a channel connected to a pixel of the display panel. The floating channel may be defined as a channel not connected to a pixel, that is, the floating channel is under no-load.

In embodiments, a display period may be defined as a period in which a source signal corresponding to image data is provided to the display panel. A sensing period may be defined as including a first period in which pixel characteristics of the display panel are sensed and a second period in which characteristics of the source driver are sensed.

In embodiments, an operation of the first period in which pixel characteristics are sensed may be divided into an initialization mode, a programming mode and a sampling mode. In this case, the initialization mode may be defined as a mode in which an operation of initializing all the pixels is performed using an initialization voltage. The programming mode may be defined as a mode in which an operation of programming pixels based on reference data is performed after the initialization mode. The sampling mode may be defined as a mode in which an operation of sampling the signals of all the pixels is performed after the programming mode.

In embodiments, a first reference voltage may be defined as a voltage provided to the floating channel in the first period in which pixel characteristics are sensed. A second reference voltage may be defined as a voltage provided to normal channels and the floating channel in the second period in which characteristics of the source driver are sensed. A third reference voltage may be defined as a voltage for initializing all the pixels in the initialization mode.

In embodiments, terms, such as first and second, may be used to distinguish between various elements. The elements are not restricted by the terms such as first and second.

Figure 1:
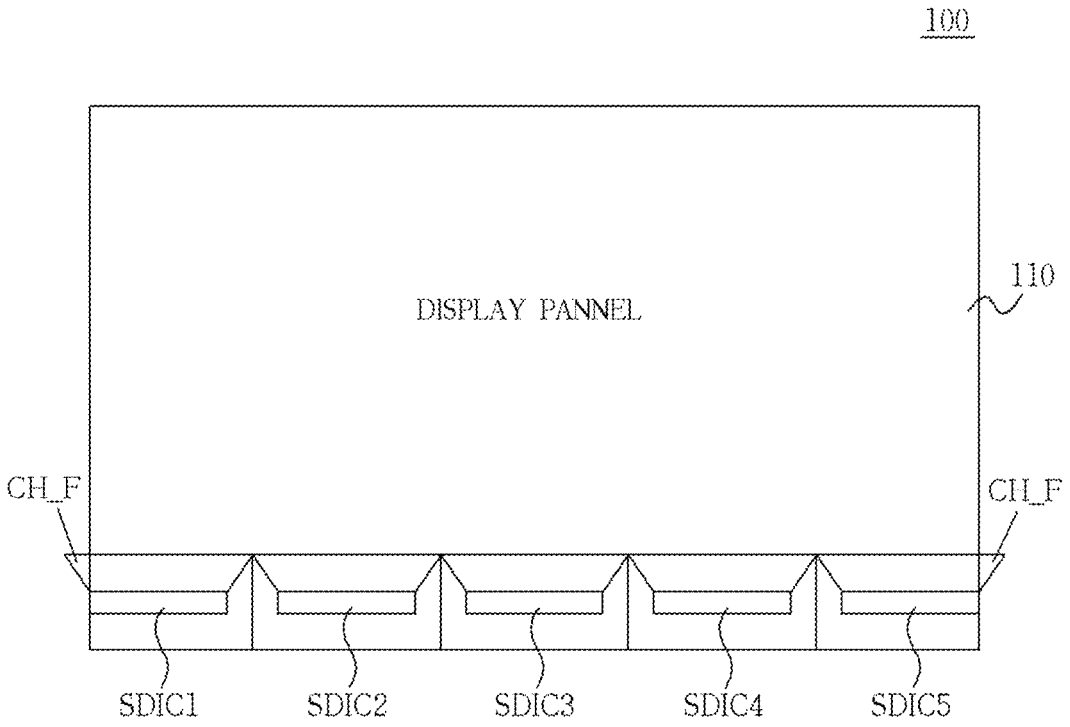
FIG. 1 is a diagram for describing a floating channel of a source driver according to an embodiment.

FIG. 1 is a diagram for describing a floating channel CH_F of a source driver SDIC according to an embodiment.

Referring to FIG. 1, a display device 100 may include a display panel 110 and a plurality of source drivers SDIC1 to SDIC5. For example, the display panel 110 may be composed of an OLED panel.

If the number of channels of the plurality of source drivers SDIC1 to SDIC5 and horizontal resolution of the display panel 110 do not become a positive number times, some of the channels of some source drivers SDIC1 and SDIC5 may be floated. In this specification, no-load channels of the source drivers SDIC1 and SDIC5 not connected to pixels of the display panel 110 are named floating channels CH_F.

If horizontal resolution of the display panel 100 and the number of channels of the plurality of source drivers SDIC1 to SDIC5 do not become a positive number times, at least one floating channel CH_F may be present in each of the source drivers SDIC1 and SDIC5. In this specification, one floating channel is illustrated for convenience of description.

Figure 2:
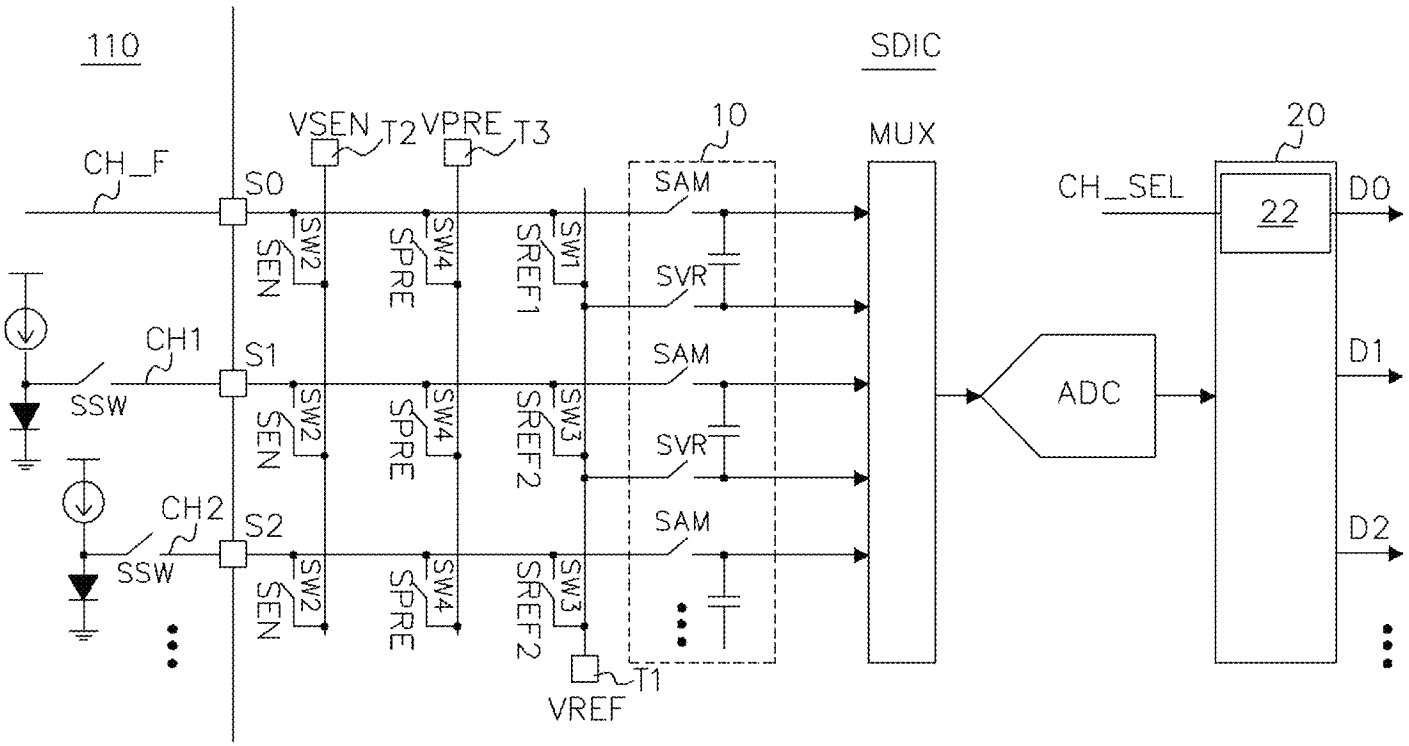
FIG. 2 is a block diagram of a display device including the source driver according to an embodiment.

FIG. 2 is a block diagram of the display device 100 illustrating a connection between the source driver SDIC and the display panel 110 according to an embodiment. The source driver SDIC in FIG. 2 may be understood to correspond to one of the source drivers SDIC1 and SDIC5 in FIG. 1.

Referring to FIG. 2, the source driver SDIC may include a sampling circuit 10, a multiplexer MUX, an analog-to-digital converter ADC and a data processing unit 20.

The sampling circuit 10 may sample a signal of a multi-channel of the source driver SDIC, and may provide a sampling signal to the multiplexer MUX.

The multi-channel means the channels of the source driver SDIC, and may include normal channels CH1 and CH2 and a floating channel CH_F. The normal channels CH1 and CH2 may be defined as channels connected to pixels of the display panel 110. The floating channel CH_F may be defined as a no-load channel not connected to a pixel of the display panel 110.

The sampling circuit 10 may sample signals of the normal channels CH1 and CH2 and the floating channel CH_F. For example, the sampling circuit 10 may sample signals of the normal channels CH1 and CH2 and the floating channel CH_F in response to a first sampling signal SAM and a second sampling signal SVR in a first period in which characteristics of pixels are sensed and a second period in which characteristics of the source driver SDIC are sensed. For example, the sampling circuit 10 may include a sampling capacitor for each multi-channel. When the sampling circuit 10 samples the signal of the multi-channel, one end of the sampling capacitor may be connected to the multi-channel in response to the first sampling signal SAM, and the other end of the sampling capacitor may be connected to a terminal T1 for a first reference voltage VREF in response to the second sampling signal SVR.

The source driver SDIC may provide the first reference voltage VREF to the floating channel CH_F in the first period in which characteristics of pixels are sensed, and may provide a second reference voltage VSEN to the normal channels CH1 and CH2 and the floating channel CH_F in the second period in which characteristics of the source driver SDIC are sensed.

The first reference voltage VREF and the second reference voltage VSEN may be set to have different levels.

For example, the first reference voltage VREF may be set to have a level corresponding to a bottom voltage for the sensing of the sampling circuit 10. The level corresponding to the bottom voltage may vary depending on a desired voltage range for sampling in the sampling circuit 10. Therefore, a level of the first reference voltage VREF may also vary depending on a bottom voltage.

Furthermore, the second reference voltage VSEN may be set to have a level corresponding to ½ of the highest level of a driving voltage. The driving voltage may be understood as a voltage for driving an analog element of the source driver SDIC. The first reference voltage VREF may be understood to correspond to a middle voltage in a full range in which the driving voltage swings.

The source driver SDIC may include a first switch SW1 for providing the first reference voltage VREF to the floating channel CH_F in the first period.

The first switch SW1 may connect the terminal T1 for the first reference voltage VREF and the floating channel CH_F in the first period. In this case, the first switch SW1 may be turned on in the first period, and may be turned off in the second period.

Figure 3:
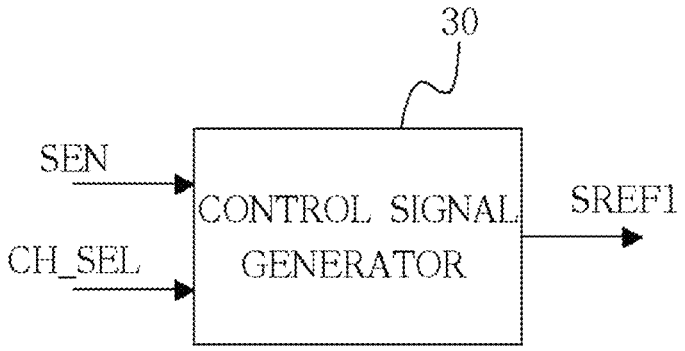
FIG. 3 is a block diagram of a control signal generator of the source driver according to an embodiment.

The source driver SDIC may include a control signal generator 30 (refer to FIG. 3). The control signal generator 30 may generate a second control signal SREF1 in response to a first control signal SEN and a floating channel selection signal CH_SEL.

In this case, the first control signal SEN may be enabled in the second period. The floating channel selection signal CH_SEL may be enabled with respect to the floating channel CH_F of the multi-channel in the first period.

Furthermore, the source driver SDIC may provide the second reference voltage VSEN to the floating channel CH_F and the normal channels CH1 and CH2 in the second period.

The source driver SDIC may include second switches SW2 for providing the second reference voltage VSEN to the floating channel CH_F and the normal channels CH1 and CH2 in the second period.

The second switches SW2 may connect a terminal T2 for the second reference voltage VSEN and the floating channel CH_F, and may connect the terminal T2 for the second reference voltage VSEN and each of the normal channels CH1 and CH2.

In the second period, the source driver SDIC may turn on the second switches SW2 and may prevent the supply of the first reference voltage VREF to the floating channel CH_F by turning off the first switch SW1.

Furthermore, the source driver SDIC may include third switches SW3 for providing the first reference voltage VREF to each of the normal channels CH1 and CH2. The third switches SW3 may be turned off in the first period and the second period if the multi-channel includes the normal channels CH1 and CH2 connected to pixels.

Furthermore, the source driver SDIC may initialize pixels of the display panel 110 based on a third reference voltage VPRE in response to an initialization signal SPRE in the initialization mode of the first period.

The source driver SDIC may include fourth switches SW4 for providing the third reference voltage VPRE to the floating channel CH_F and the normal channels CH1 and CH2 in the initialization mode.

The fourth switches SW4 may connect a terminal T3 for the third reference voltage VPRE and the floating channel CH_F, and may connect the terminal T3 for the third reference voltage VPRE and each of the normal channels CH1 and CH2.

The source driver SDIC may turn on the fourth switches SW4 in the initialization mode, and may prevent the supply of the first reference voltage VREF to the floating channel CH_F by turning off the first switch SW1, and may prevent the supply of the second reference voltage VSEN to the floating channel CH_F and the normal channels CH1 and CH2 by turning off the second switches SW2.

At this time, sensing switches SSW connected to pixels of the display panel 110 may be turned on, and the sampling circuit 10 may be turned off.

The multiplexer MUX may receive a sampling signal from the sampling circuit 10, and may provide the sampling signal to the analog-to-digital converter ADC in a preset sequence.

The analog-to-digital converter ADC may convert, into digital data, sampling signals sequentially provided by the multiplexer MUX, and may provide the digital data to the data processing unit 20.

The data processing unit 20 may provide a timing controller (not illustrated) with digital data D1 and D2 corresponding to the normal channels CH1 and CH2. Furthermore, the data processing unit 20 may process, into a fixed digital code, digital data D0 corresponding to the floating channel CH_F, and may provide the fixed digital code to the timing controller.

The data processing unit 20 may include a floating data processing circuit 22. The floating data processing circuit 22 may process the digital data D0 of the floating channel CH_F into a fixed digital code in response to the floating channel selection signal CH_SEL. For example, the floating channel selection signal CH_SEL may be restored from a packet form of input data provided by the timing controller or may be internally generated.

FIG. 3 is a block diagram of the control signal generator 30 of the source driver SDIC according to an embodiment.

Referring to FIG. 3, the control signal generator 30 may generate the second control signal SREF1 for controlling the first switch SW1 in response to the first control signal SEN and the floating channel selection signal CH_SEL.

The control signal generator 30 may enable the second control signal SREF1 in the first period in response to the first control signal SEN and the floating channel selection signal CH_SEL, and may disable the second control signal SREF1 in the second period. In this case, the first control signal SEN may be enabled in the second period, and the floating channel selection signal CH_SEL may be enabled with respect to the floating channel CH_F of the multi-channel in the first period.

Figure 4:
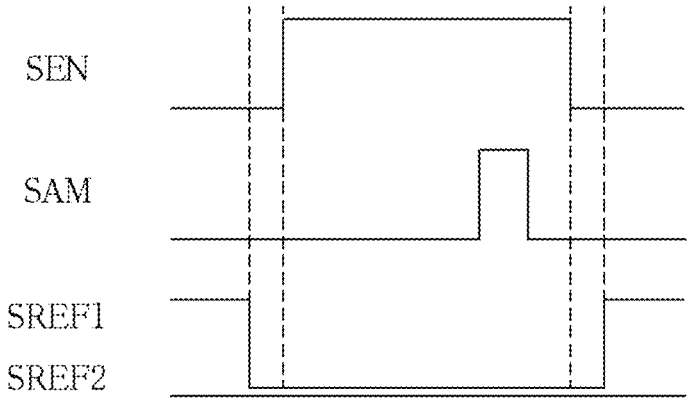
FIG. 4 is a timing diagram for describing an operation of sampling characteristics of the source driver by the source driver according to an embodiment.

FIG. 4 is a timing diagram for describing an operation of sampling characteristics of the source driver SDIC by the source driver SDIC according to an embodiment.

Referring to FIGS. 2 and 4, first, the source driver SDIC may provide the second reference voltage VSEN to the normal channels CH1 and CH2 and the floating channel CH_F in response to the first control signal SEN in the second period.

At this time, the source driver SDIC may turn off the first switch SW1 and turn on the second switches SW2 in the second period. As described above, in the second period, the source driver SDIC may prevent the supply of the first reference voltage VREF to the floating channel CH_F and supply the second reference voltage VSEN to the normal channels CH1 and CH2 and the floating channel CH_F.

In this case, a given margin time may be set between a turn-off time of the first switch SW1 and a turn-on time of the second switches SW2 and between a turn-off time of the second switches SW2 and a turn-on time of the first switch SW1.

Thereafter, the source driver SDIC may sample signals of the normal channels CH1 and CH2 and the floating channel CH_F in response to the first sampling signal SAM and the second sampling signal SVR, and may sequentially convert the sampling signals into digital data.

At this time, the source driver SDIC may process, into a fixed digital code, the digital data corresponding to the signal of the floating channel CH_F.

Thereafter, the source driver SDIC may provide the timing controller with the digital data corresponding to the normal channels CH1 and CH2 and the fixed digital code corresponding to the floating channel CH_F.

The timing controller may calculate characteristics of the source driver by using the digital data provided by the source driver SDIC. In this case, the timing controller may distinguish between the digital data corresponding to the normal channels CH1 and CH2 and data corresponding to the floating channel CH_F by using the fixed digital code.

Figure 5:
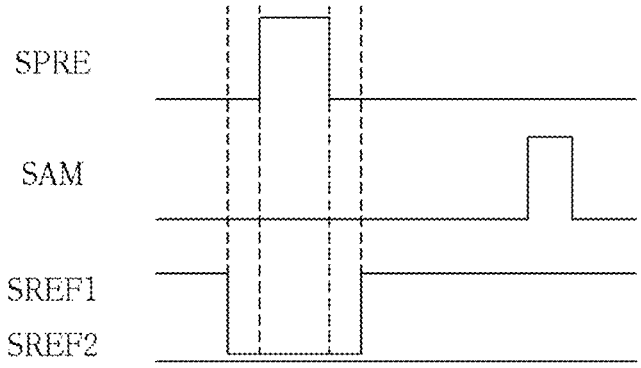
FIG. 5 is a timing diagram for describing an operation of sampling characteristics of pixels by the source driver according to an embodiment.

FIG. 5 is a timing diagram for describing an operation of sampling characteristics of pixels by the source driver according to an embodiment.

Referring to FIGS. 2 and 5, the source driver SDIC may initialize pixels of the display panel 110 based on the third reference voltage VPRE in response to the initialization signal SPRE in the initialization mode of the first period. At this time, sensing switches SSW connected to the pixels of the display panel 110 may be turned on. The second switches SW2, the first switch SW1 and the sampling circuit 10 may be turned off.

Furthermore, for example, the source driver SDIC may initialize the pixels of the display panel 110 based on the second reference voltage VSEN in response to the first control signal SEN in the initialization mode of the first period. At this time, a sensing switch SSW and the second switches SW2 connected to the pixels of the display panel 110 may be turned on, and the first switch SW1 and the sampling circuit 10 may be turned off.

Thereafter, the source driver SDIC may program the pixels of the display panel 100 based on reference data in the programming mode of the first period. At this time, the second switches SW2 and the sampling circuit 10 may be turned off, and the first switch SW1 may be turned on.

Thereafter, the source driver SDIC may sample signals of the pixels of the display panel 100 in the sampling mode of the first period. At this time, the second switches SW2 may be turned off, and the sampling circuit 10 and the first switch SW1 may be turned on.

In this case, a given margin time may be set between an enable time of the second control signal SREF1 and an enable time of the initialization signal SPRE.

Thereafter, the source driver SDIC may sample signals of the normal channels CH1 and CH2 and the floating channel CH_F in response to the first sampling signal SAM and the second sampling signal SVR, and may sequentially convert the sampling signals into digital data.

At this time, the source driver SDIC may process, into a fixed digital code, the digital data corresponding to the signal of the floating channel CH_F.

Thereafter, the source driver SDIC may provide the timing controller with the digital data corresponding to the normal channels CH1 and CH2 and the fixed digital code corresponding to the floating channel CH_F.

The timing controller may calculate characteristics of the pixels of the display panel 110 by using the digital data provided by the source driver SDIC. In this case, the timing controller may distinguish between the digital data corresponding to the normal channels CH1 and CH2 and data corresponding to the floating channel CH_F by using the fixed digital code.

As described above, according to embodiments, a problem in that an operation of the floating channel CH_F for sensing unknown input affects data of normal channels CH1 and CH2 adjacent to the floating channel CH_F can be prevented by providing the first reference voltage VREF to the floating channel CH_F when characteristics of pixels are sensed.

Furthermore, embodiments can simplify a process of calculating characteristics of the source driver and characteristics of pixels because the timing controller can distinguish between digital data of the normal channels CH1 and CH2 and the floating channel CH_F upon data processing.

What is claimed is:

1. A source driver comprising:

a normal channel connected to pixels of a display panel;

a floating channel under no-load; and a sampling circuit configured to sample signals of the normal channel and the floating channel, wherein the source driver provides, via a first switch, a first reference voltage to the floating channel in a first period in which characteristics of the pixels are sensed, and wherein the first switch is turned on in the first period and turned off in a second period in which characteristics of the source driver are sensed.

2. The source driver of claim 1, further comprising a control signal generator configured to generate a second control signal enabled in the first period and disabled in the second period and to provide the second control signal to the first switch.

3. The source driver of claim 1, wherein the first reference voltage is set to have a level corresponding to a bottom voltage for the sensing of the sampling circuit.

4. The source driver of claim 1, wherein a second reference voltage is provided to the normal channel and the floating channel in a second period in which characteristics of the source driver are sensed.

5. The source driver of claim 4, further comprising second switches configured to provide the second reference voltage to the normal channel and the floating channel in the second period, wherein the second switches are turned on in the second period and turned off in the first period.

6. The source driver of claim 4, wherein the second reference voltage is set to have a level corresponding to ½ of a highest level of a driving voltage.

7. The source driver of claim 1, further comprising a data processing unit configured to process digital data of the floating channel into a fixed digital code.

8. A source driver comprising:

a sampling circuit configured to sample a signal of a multi-channel comprising a normal channel and a floating channel and provide a sampling signal;

a multiplexer configured to output the sampling signal to an analog-to-digital converter in a preset sequence; and the analog-to-digital converter configured to convert the sampling signal into digital data, wherein the source driver provides, via a first switch, a first reference voltage to the floating channel in a first period in which characteristics of pixels of a display panel are sensed through the normal channel, and wherein the first switch is turned on in the first period and turned off in the second period in which characteristics of the source driver are sensed.

9. The source driver of claim 8, wherein a second reference voltage is provided to the normal channel and the floating channel in a second period in which characteristics of the source driver are sensed.

10. The source driver of claim 9, wherein the first reference voltage is set to have a level corresponding to a bottom voltage for the sensing of the sampling circuit.

11. The source driver of claim 8, further comprising second switches configured to provide a second reference voltage to the normal channel and the floating channel in a second period in which characteristics of the source driver are sensed, wherein the second switches are turned on in the second period and turned off in the first period.

12. The source driver of claim 11, wherein the second reference voltage is set to have a level corresponding to ½ of a highest level of a driving voltage.

13. The source driver of claim 8, further comprising a data processing unit configured to process digital data of the floating channel into a fixed digital code.

* * * * *